US006950000B1

(12) United States Patent
Lanni et al.

(10) Patent No.: US 6,950,000 B1
(45) Date of Patent: Sep. 27, 2005

(54) HIGH INITIAL FORCE ELECTROMAGNETIC ACTUATOR

(75) Inventors: Arthur L. Lanni, Cary, NC (US); Varagur R. Ramanan, Cary, NC (US)

(73) Assignee: ABB Technology AG, (CH)

( * ) Notice: Subject to any disclaimer, the term of this patent is extended or adjusted under 35 U.S.C. 154(b) by 0 days.

(21) Appl. No.: 10/041,001

(22) Filed: Dec. 28, 2001

(51) Int. Cl.[7] ..... H01F 7/00
(52) U.S. Cl. ..... 335/229; 335/220; 251/129.15
(58) Field of Search ..... 335/256, 250–251, 335/276–282, 220–234, 236; 251/129.1–129.18, 251/129.01–15

(56) References Cited

U.S. PATENT DOCUMENTS 3,022,450 A * 2/1962 Chase, Jr. ..... 361/194
3,545,472 A * 12/1970 Franz ..... 137/116.5
3,792,390 A 2/1974 Boyd
3,805,204 A 4/1974 Petersen
3,860,894 A 1/1975 Popovic et al.
3,987,385 A 10/1976 Diller et al.
4,072,918 A 2/1978 Read, Jr.
4,218,669 A 8/1980 Hitchcock et al.
4,236,130 A 11/1980 Hubert
4,321,570 A * 3/1982 Tsunefuji ..... 335/229
4,442,418 A 4/1984 Myers
4,443,775 A 4/1984 Fujitani et al.
4,602,233 A 7/1986 Pavlovsky et al.
4,633,209 A 12/1986 Belbel et al.
4,664,136 A * 5/1987 Everett ..... 137/85
4,683,452 A 7/1987 Henley
4,686,501 A 8/1987 Palmier et al.
4,711,266 A * 12/1987 Leiber ..... 137/554
4,812,795 A 3/1989 Zabar
4,812,884 A 3/1989 Mohler
4,835,503 A 5/1989 Everett
4,859,975 A 8/1989 Uetsuhara
5,110,087 A 5/1992 Studtmann et al.
5,202,658 A 4/1993 Everett et al.
5,515,818 A 5/1996 Born
5,547,165 A 8/1996 Brehm et al.
5,912,604 A 6/1999 Harvey et al.
6,125,803 A * 10/2000 Hattori et al. ..... 123/90.11
6,198,605 B1 3/2001 Briggs et al.
6,816,048 B2 * 11/2004 Morita et al. ..... 335/220
2002/0121828 A1 9/2002 Ketschau et al.

* cited by examiner

*Primary Examiner*—Lincoln Donovan
(74) *Attorney, Agent, or Firm*—Paul R. Katterle, Esq.; Woodcock Washburn LLP

(57) ABSTRACT

An electromagnetic actuator is provided that comprises a housing, a solenoid coil, and an armature. The armature can move between a first position proximate a portion of the housing and a second position distal of the portion of the housing. The armature and the portion of the housing define a first gap and an extension member extends in an axial direction into the first gap, thereby defining a second gap. The width of the second gap is less than the width of the first gap. The length and shape of the extension member may be varied to produce increased initial magnetic force from the solenoid coil on the armature. The length and shape of the extension member may also be varied to produce a desired armature force-displacement curve over the stroke of the actuator.

18 Claims, 4 Drawing Sheets

HIGH INITIAL FORCE ELECTROMAGNETIC ACTUATOR

FIELD OF THE INVENTION

The invention relates to electromagnetic actuators, and more particularly, to high initial force electromagnetic actuators.

BACKGROUND OF THE INVENTION

An electromagnetic actuator is a device that converts electrical energy into mechanical movement. It consists primarily of two parts, a solenoid coil and an armature. Generally, the coil is formed from wire that has been wound into a cylindrical shape. The armature is typically mounted to move or slide axially with respect to the cylindrically shaped coil. An electrical signal applied to the coil generates an electromagnetic field that imparts a force on the armature, thereby causing the armature to move.

An electromagnetic actuator may be used to actuate a mechanism, for example, a valve, a circuit breaker, a recloser, a switchgear, and the like. Each mechanism needs a certain amount of force to operate the mechanism. Further, many of the mechanisms have a limited amount of space to contain the electromagnetic actuator and therefore, electromagnetic actuators are often designed to have a low profile to fit into a limited amount of space. Often, such low profile actuators cannot provide enough force to actuate the mechanism.

Consequently, a need exists for a low profile electromagnetic actuator that is capable of generating sufficient force to actuate a mechanism.

SUMMARY OF THE INVENTION

The invention is directed to an electromagnetic actuator having an increased initial force.

The electromagnetic actuator comprises a housing, a solenoid coil, and an armature. The armature can move between a first position proximate a portion of the housing and a second position distal of the portion of the housing. In the second position, the armature and the portion of the housing define a first gap and an extension member extends in an axial direction into the first gap, thereby defining a second gap. The width of the second gap is less than the width of the first gap.

According to another aspect of the invention, the electromagnetic actuator comprises a housing, a solenoid coil, a shaft, and an armature. The housing comprises a body and an extension member that has an inner surface. The solenoid coil is disposed in the housing and the shaft is disposed substantially coaxially with the solenoid coil. The armature has an outer surface and is coupled to the shaft so that the shaft and armature can move between a first position proximate the solenoid coil and a second position distal of the solenoid coil. In the second position, the armature and the body of the housing define a first gap. The extension member extends in an axial direction towards the armature and beyond the solenoid coil such that the inner surface of the extension member and the outer surface of the armature define a second gap. The width of the second gap is less than the width of the first gap. The length of the extension member may be varied to produce increased initial magnetic force from the solenoid coil on the armature.

The housing, extension member, and armature may be substantially annularly shaped. The extension member may have a substantially annular inner surface and the armature may have a substantially annular outer surface, wherein the inner surface and outer surface define a substantially annular gap.

The inner surface of the extension member and the outer surface of the armature may be substantially parallel such that the second gap width between the extension member and the armature is substantially constant between the extension member and the armature. The inner surface of the extension member and the outer surface of the armature may be not parallel. The second gap width may increase with the increasing distance from the solenoid and the second gap width may decrease with the increasing distance from the solenoid.

The electromagnetic actuator may comprise a substantially annular shaped permanent magnet disposed in the housing, wherein the permanent magnet biases the armature towards the solenoid.

These and other features of the invention will be more fully set forth hereinafter.

BRIEF DESCRIPTION OF THE DRAWINGS

The invention is further described in the detailed description that follows, by reference to the noted drawings by way of non-limiting illustrative embodiments of the invention, in which like reference numerals represent similar elements throughout the several views of the drawings, and wherein.

DETAILED DESCRIPTION OF ILLUSTRATIVE EMBODIMENTS

As described above, many low profile electromagnetic actuators cannot provide enough force to actuate a particular mechanism. Increasing the initial force of an actuator, however, may provide enough force to actuate the mechanism. That is, if the electromagnetic actuator can be configured to provide a higher initial force, the resultant increased acceleration and inertia may be sufficient to actuate the mechanism. As such, the invention is directed to an electromagnetic actuator having an increased initial force.

Figure 1:
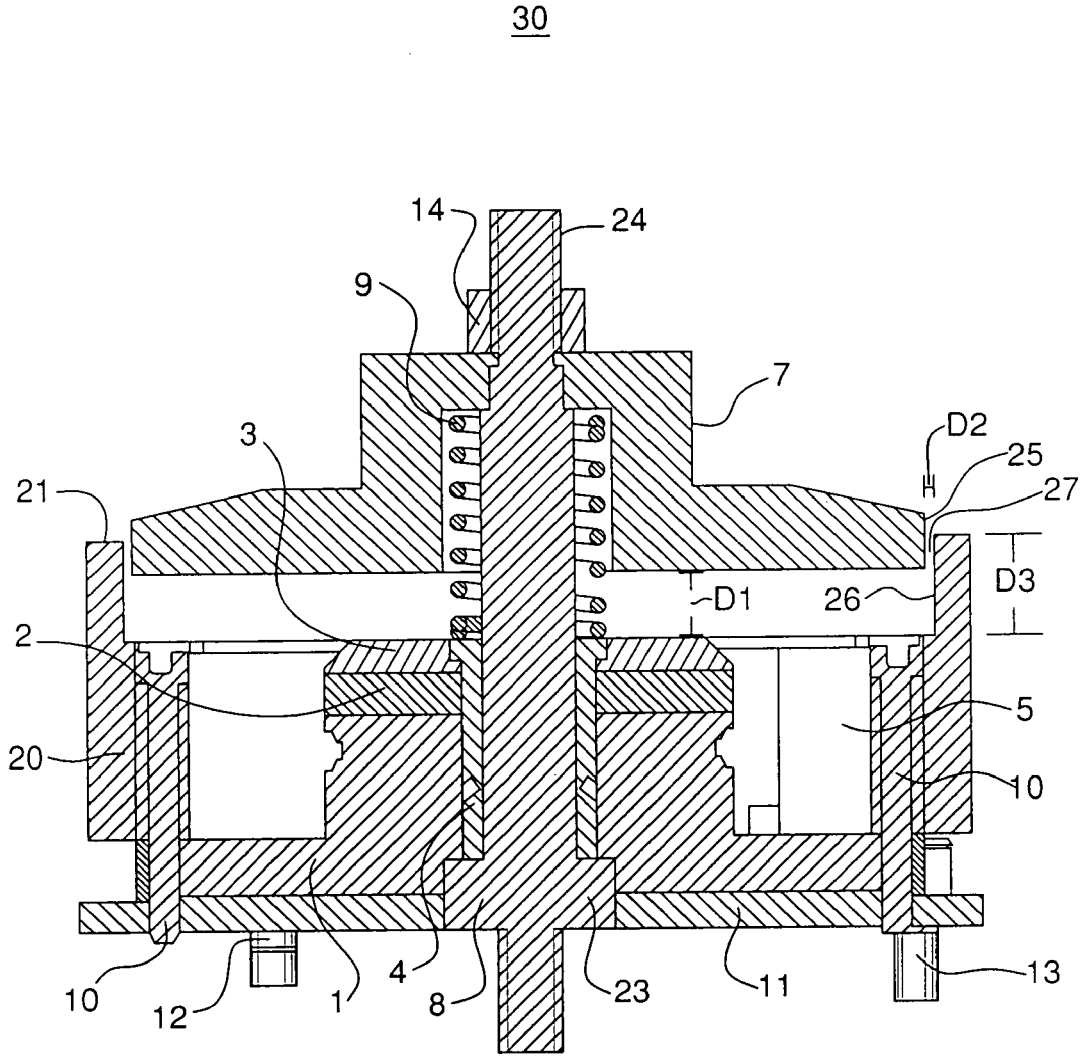
FIG. 1 is a cut-away view of an illustrative electromagnetic actuator in the open position, in accordance with an embodiment of the invention.

FIG. 1 is a cut-away view of an illustrative electromagnetic actuator in the open position, in accordance with an embodiment of the invention. As shown in FIG. 1, actuator 30 comprises a solenoid coil 5, a shaft 8, an armature 7, and a housing 20.

Solenoid coil 5 comprises a conductor wound into a cylindrical shape and lead wires (not shown) for connection of electrical power to the conductor. Connection of electrical power to solenoid coil 5 creates a magnetic field that exerts a force on some materials. The greater the number of conductor turns wound in solenoid coil 5, the greater the force exerted when the solenoid coil is energized. The direction of force depends on the polarity of electrical power applied to the lead wires. For example, applying positive voltage to the leads may result in an upward force on armature 7 and applying negative voltage may result in a downward force on armature 7. The strength of the force also depends on the stroke of armature 7. That is, when armature 7 is located distal of solenoid coil 5, the electromagnetic force on armature 7 is weaker than when armature 7 is proximate solenoid coil 5.

As shown, solenoid coil 5 is disposed between a base plate 11 and a clamp plate 3 and within a cavity defined by housing 20. Base plate 11 is substantially planar; however, base plate 11 may be any shape that secures solenoid coil 5 within housing 20. Base plate 11 comprises threaded holes for receiving fasteners 10 for securing clamp plate 3 and housing 20 to base plate 11; however, other fastening techniques are contemplated. Base plate 11 has a passage for receiving shaft 8; however, such passage may not be included if shaft 8 does not extend past base plate 11.

Base plate 11 extends beyond housing 20 for mounting electromagnetic actuator 30 to another device, such as for example, a valve, a circuit breaker, a recloser, a switchgear, and the like. Base plate 11 has holes for fasteners 12 and fasteners 13. While fasteners 12 and 13 are illustrated as countersunk screws and socket head screws, respectively, other fasteners and other mounting techniques are contemplated.

Core 1 comprises magnetically permeable material and is substantially annular shaped. Core 1 has an annular recess for receiving solenoid coil 5 and an axial passage for receiving a bushing 4; however, core 1 may be any shape to provide a magnetic circuit for solenoid coil 5. Core 1 has through-holes for receiving fasteners 10; however, core 1 may not include through-holes if fasteners 10 are located outside of core 1. Core 1 is disposed on base plate 11 with its axial passage aligned with the passage of base plate 11 and with its through holes aligned with the threaded holes of base plate 11.

Permanent magnet 2 is substantially annularly shaped and has an axial passage for bushing 4; however, permanent magnet 2 may be any suitable shape. Permanent magnet 2 is aligned such that its magnetic poles provide a magnetic force biasing armature 7 towards solenoid coil 5. The force is strongest when permanent magnet 2 is proximate armature 7 and weakest when permanent magnet 2 is distal of armature 7. Permanent magnet 2 is disposed on core 1, typically proximate armature 7 to provide increased magnetic force on armature 7. Permanent magnet 2 is used with one technique for stroking actuator 30 but may be omitted with other techniques, as described in more detail below.

Housing 20 is substantially annularly shaped and defines a cavity that contains core 1, solenoid coil 5, permanent magnet 2, clamp plate 3, and bushing 4. Housing 20 has through-holes corresponding to the through-holes of core 1 for receiving fasteners 10. Housing 20 is disposed on core 1 with its through-holes aligned with the through-holes of core 1. Housing 20 comprises a substantially annular extension member 21 extending in an axial direction towards armature 7 and beyond solenoid coil 5 and clamp plate 3. Housing 20 and extension member 21 may be any suitable shape that can define a gap with armature 7, as described in more detail below. Extension member 21 may be integrally formed with housing 20 or may be a separate piece attached to housing 20. Such attachment may be, for example, a weld, an adhesive, a fastener, or the like. Extension member 21 defines an annular inner surface 26. Extension member 21 provides increased initial magnetic force on armature 7, as described in more detail below.

Clamp plate 3 is substantially annularly shaped and has through-holes corresponding to the through holes of housing 20 and an axial passage corresponding to the passage of permanent magnet 2. Clamp plate 3 may be any suitable shape and may utilize any fastening technique for securing permanent magnet 2, solenoid coil 5, and core 1 within housing 20. Fasteners 10, shown as socket head cap screws, are disposed through the through-holes of clamp plate 3, the through-holes of housing 20, the through-holes of core 1, and are threaded into the threaded holes of base plate 11.

Bushing 4 is substantially cylindrically shaped and is disposed in the passage of core 1, the passage of permanent magnet 2, and the passage of clamp plate 3. Bushing 4 secures shaft 8 such that shaft 8 may move axially.

Shaft 8 is substantially cylindrically shaped and is disposed in bushing 4. Shaft 8 comprises a shaft collar 23 at one end of shaft and threads 24 on the other end of shaft 8. Shaft collar 23 is proximate core 1 and is larger than the passage of core 1 and therefore, limits the axial travel of shaft 8 in one direction. Threads 24 are distal of core 1 and mate with a fastener 14 to limit the axial travel of shaft 8 in the other direction. Fastener 14 is shown as a hex nut engaged to threads 24; however, other fastening techniques are contemplated.

Spring 9 is disposed over shaft 8 between clamp plate 3 and armature 7. Spring 9 is under compression and therefore biases armature 7 away from solenoid coil 5. Spring 9 is sized depending on the technique used for stroking actuator 30, as described in more detail below.

Armature 7 comprises magnetically permeable material and has an outer surface 25. Outer surface 25 may be substantially annularly shaped or may be any other shape suitable for defining a gap with the inner surface of extension member 21. Armature 7 has a passage that receives shaft 8 and is disposed substantially coaxially with solenoid coil 5. Armature 7 is secured to shaft 8 via fastener 14; however, armature 7 may be secured to shaft 8 with other techniques, such as welding and the like. Armature 7 has a cylindrical recess that receives spring 9; however, it is contemplated that armature 7 may not include a recess.

To explain one technique for the operation of electromagnetic actuator 30, FIG. 1 illustrates electromagnetic actuator 30 in the open position (i.e., armature 7 is located distal of solenoid coil 5) with no power being delivered to solenoid coil 5. As can be seen, armature 7 and the body of housing 20 define a gap having a width D1. Also, the outer surface 25 of armature 7 is located a distance D2 from inner surface 26 of housing extension member 21, thereby defining an annular air gap 27 having a width D2. Width D2 is less than width D1, thereby increasing initial force, as described in more detail below.

Spring 9 biases armature 7 away from solenoid coil 5 and permanent magnet 2 biases armature 7 towards solenoid coil 5. Because armature 7 is located distal of permanent magnet 2, the magnetic force from permanent magnet 2 acting on armature 7 is relatively small compared to the mechanical force applied by spring 9. As such, armature 7 remains in the open position, until another force is applied.

Figure 2:
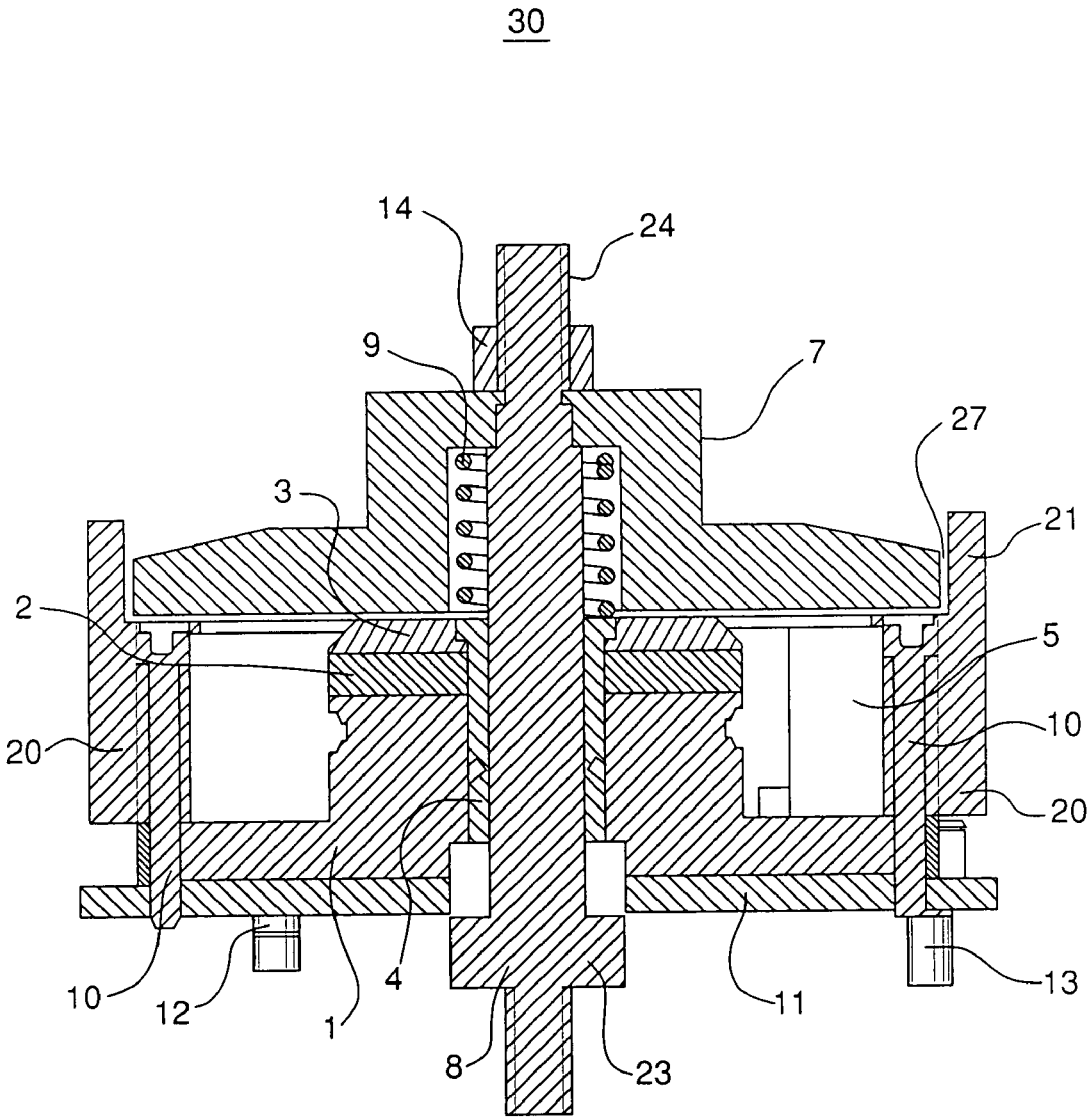
FIG. 2 is a cut-away view of the actuator of FIG. 1 in the closed position.

When a current is applied to solenoid coil 5, a magnetic force acts on armature 7, pulling armature 7 towards solenoid coil 5. To further describe the magnetic force, a magnetic circuit exists around a cross section of solenoid coil 5. That is, a magnetic circuit exists from core 1, through housing 20, housing extension member 21, across air gap 27, through armature 7, across the air gap having width D1, through clamp plate 3 and permanent magnet 2, and back to core 1. The magnetic circuit provides a path for the magnetic flux to create a magnetic force on armature 7. The magnetic force from energized solenoid coil 5 is stronger than the force applied by spring 9 and therefore, armature 7 moves to the closed position, which is illustrated in FIG. 2.

Because extension member 21 extends beyond clamp plate 3 and defines a small annular air gap 27, rather than a large air gap (e.g., an air gap having a width D1), armature 7 moves towards solenoid coil 5 with a higher initial force. As such, electromagnetic actuator 30 may actuate larger mechanisms than if actuator 30 did not have extension member 21. As such, the same size solenoid coil and armature can actuate a larger mechanism than otherwise possible. Extension member 21, therefore, can increase the force delivered by electromagnetic actuator 30 without significantly increasing the space taken by actuator 30.

Once in the closed position, armature 7 remains in the closed position until another force acts on armature 7. Armature 7 remains in the closed position because permanent magnet 2 is now located proximate armature 7 and therefore, exerts a larger force than the opposing force exerted by spring 9. As such, even if power is removed from solenoid coil 5, armature 7 remains in the closed position.

To return armature 7 to the open position, an opposite direction current may be placed on solenoid coil 5. Such current creates a magnetic field that exerts an upward magnetic force on armature 7 that is greater than the downward magnetic force from permanent magnet 2, thereby returning armature 7 to the open position. Armature 7 remains in the open position because permanent magnet 2 is now located distal of armature 7 and therefore, exerts a smaller force than the opposing force exerted by spring 9. As such, even if power is removed from solenoid coil 5, armature 7 remains in the open position.

Different lengths D3 of extension member 21 affect the force-stroke distance characteristic of actuator 30. To illustrate the effect of different lengths of extension member 21, the magnetic force exerted on armature 7 by solenoid coil 5 was calculated for a variety of stroke lengths D1 and a variety of extension member 21 lengths D3 using a finite element analysis software package. The results are summarized in Table 1 below with the forces indicated in Newtons.

TABLE 1

| | D3 = 0 mm | D3 = 12 mm | D3 = 15 mm | D3 = 36 mm |
|---|---|---|---|---|
| D1 = 16 mm (open) | 305 | 563 | 693 | 558 |
| D1 = 14 mm | 394 | 777 | 868 | 688 |
| D1 = 7 mm | 1136 | 1740 | 1693 | 1603 |
| D1 = 0 mm (closed) | 9925 | 10,010 | 9994 | 9965 |

As can be seen, for an electromagnetic actuator 30 that does not have an extension member (i.e., has a length D3=0), the initial force is 305 N. With an extension member 21 having a length D3=12 mm, however, the initial force increases to 563 N. Such an increase in initial force may provide the acceleration and inertia to actuate larger mechanisms without utilizing a larger solenoid coil. Another feature of extension member 21 is that armature 7 may have a substantially constant acceleration, thereby resulting in consistent closing times, which is important in some actuator applications.

Figure 3:
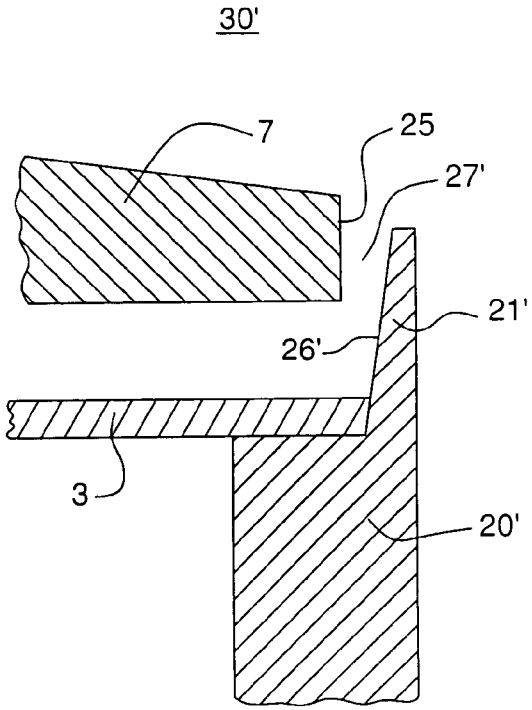
FIG. 3 is a cut-away view of a portion of another illustrative electromagnetic actuator, in accordance with another embodiment of the invention.

Further, the force-displacement curve over the stroke of the actuator may be controlled by varying the shape of air gap 27, for example by varying the length and shape of the extension member. For example, the width of gap 27 can increase with increasing distance from clamp plate 3, such as shown in FIG. 3. As shown, extension member 21' extends from housing 20'. Extension member 21' has an inner annular surface 26' that forms an annular air gap 27'. Air gap 27' becomes wider as the distance from clamp plate 3 increases. With such an air gap, the initial force is less than that of FIG. 1, but increases faster with increasing armature 7 stroke.

Figure 4:
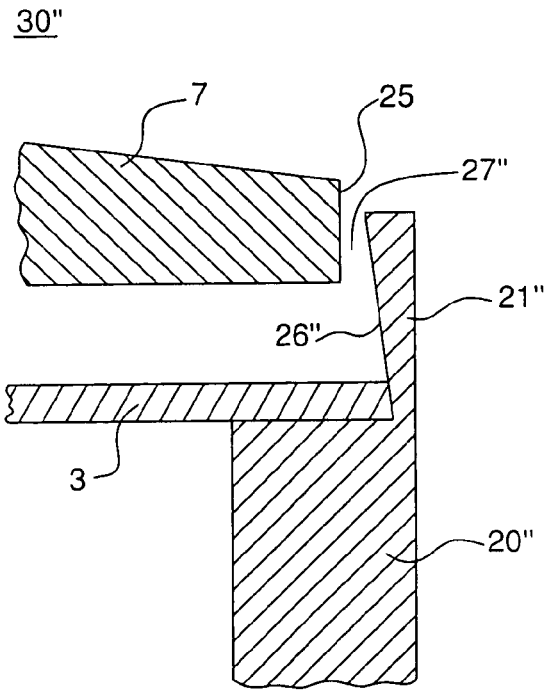
FIG. 4 is a cut-away view of a portion of another illustrative electromagnetic actuator, in accordance with another embodiment of the invention.

FIG. 4 shows another actuator 30". As shown, extension member 21" extends from housing 20". Extension member 21" has an inner annular surface 26" that forms an annular air gap 27". Air gap 27" becomes narrower as the distance from clamp plate 3 increases. While linearly increasing and decreasing air gaps are illustrated, other shaped air gaps are also contemplated, such as for example, curved, saw-tooth shaped, square, and the like.

Further, other techniques for stroking actuator 30 are contemplated. For example, permanent magnet 2 is not required for the operation of actuator 30. If permanent magnet 2 is not included in actuator 30, power is continuously applied to solenoid coil 5 to maintain actuator 30 in the closed position. In another alternate embodiment, spring 9 is in tension and biases armature 7 towards solenoid coil 5.

Figure 5:
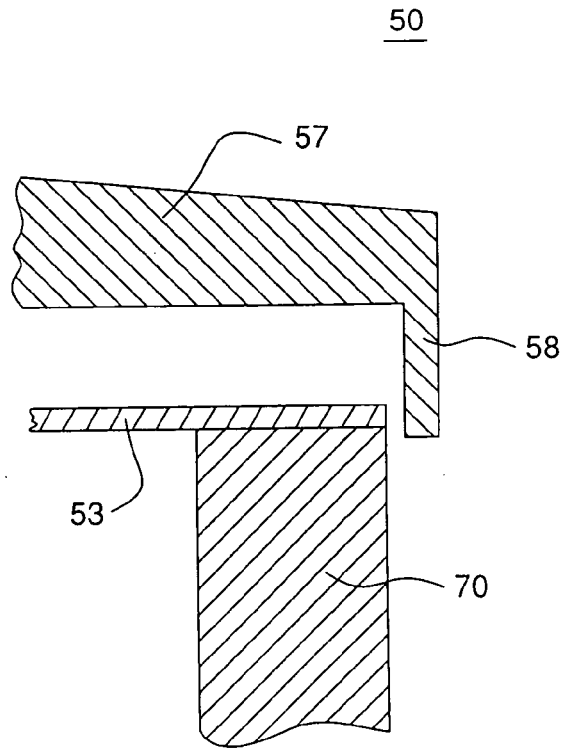
FIG. 5 is a cut-away view of a portion of yet another illustrative electromagnetic actuator, in accordance with another embodiment of the invention.

FIG. 5 shows a portion of another illustrative electromagnetic actuator 50 that is similar to electromagnetic actuator 30. As shown in FIG. 5, electromagnetic actuator 50 comprises a housing 70 and a clamp plate 53. Clamp plate 53 is similar to clamp plate 3 of FIG. 1. Housing 70 is similar to housing 20 of FIG. 1; however, in this embodiment, housing 70 does not have an extension member. Rather, in this embodiment, an actuator 57 comprises an extension member 58. Armature 57 and extension member 58 may be any suitable shape that can define a gap with housing 70, as described above. Extension member 58 may be integrally formed with armature 57 or may be a separate piece attached to armature 57. Such attachment may be, for example, a weld, an adhesive, a fastener, or the like. Extension member 58 and housing 70 define a gap therebetween. The gap increases the initial force on armature 57, as described above.

Figure 6:
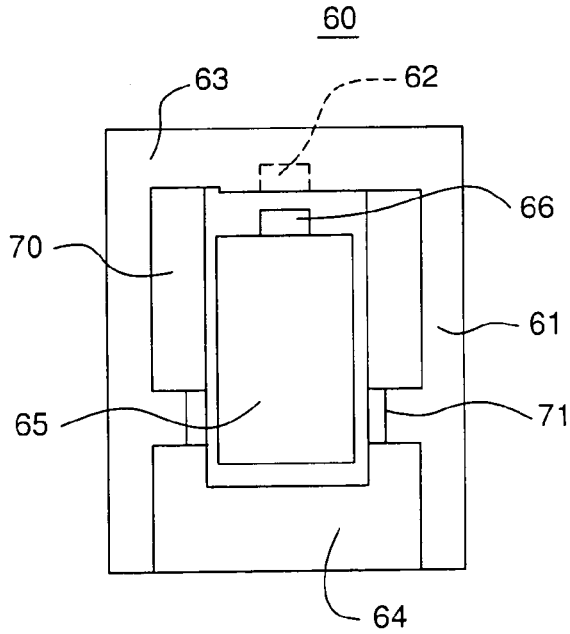
FIG. 6 is a cut-away view of another illustrative electromagnetic actuator, in accordance with another embodiment of the invention.

FIG. 6 shows another illustrative embodiment of the invention. As shown in FIG. 6, electromagnetic actuator 60 comprises a housing 61, an armature 65, and a solenoid coil 70.

Solenoid coil 70 is similar to solenoid coil 5 of FIG. 1. As shown, solenoid coil 70 is disposed within a cavity defined by housing 61.

Electromagnetic actuator 60 also comprises a permanent magnet 71. Permanent magnet 71 is substantially annularly shaped and has an axial passage for armature 65; however, permanent magnet 71 may be any suitable shape. Permanent magnet 71 is aligned such that its magnetic poles provide a magnetic force biasing armature 65. Permanent magnet 71 is used with one technique for stroking actuator 60 but may be omitted with other techniques.

Armature 65 comprises magnetically permeable material and an extension member 66. Extension member 66 extends toward an end cap 63 of housing 61, thereby defining a gap between extension member 66 and housing 61. The gap is less than would otherwise exist and increases the initial force of electromagnetic actuator 60, as described above. Extension member 66 may be integrally formed with armature 65 or may be a separate piece attached to armature 65.

Armature 65 is substantially cylindrically shaped and is disposed in solenoid coil 70; however armature 65 may be any shape to cooperate with solenoid coil 70 to produce axial motion. Armature 65 is disposed between end caps 63 and 64 of housing 61. End caps 63 and 64 limit the axial travel of armature 65.

Housing 61 is substantially annularly shaped and defines a cavity that contains solenoid coil 70, permanent magnet 71, and armature 65. Housing 61 also comprises an end cap 63 and 64 that substantially enclose armature 65. End cap 63 further comprises a recess 62 for receiving extension member 66 of armature 65. Housing 61 and recess 62 may be any suitable shape that can cooperate with extension member 66 of armature 65. In other embodiments, housing 61 may comprise an extension member and armature 65 may comprise a recess for receiving the extension member.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

What is claimed is:

1. An electromagnetic actuator comprising:

a housing defining a cavity;

a solenoid coil disposed in the cavity of the housing, said solenoid coil having an axial passage extending therethrough and an outer periphery;

a shaft extending through the axial passage of the solenoid coil and having a longitudinal axis;

a clamp surface disposed in the cavity;

an armature secured to the shaft and extending outward from the shaft to an outer peripheral surface, which is disposed outward from the axial passage of the solenoid coil, said armature being movable between a first position disposed proximate to the clamp surface and a second position disposed distal to the clamp surface, wherein when the armature is in the first position, the armature and the housing define an outwardly-extending first gap therebetween, and when the armature is in the second position, the armature and the clamp surface define a longitudinally-extending second gap therebetween, said first gap having a width in a direction normal to the longitudinal axis of the shaft and said second gap having a width in the direction of the longitudinal axis of the shaft, and wherein the width of the second gap is greater than the width of the first gap; and a permanent magnet disposed in the axial passage of the solenoid coil and operable to bias the armature toward the first position.

2. The electromagnetic actuator of claim 1 further comprising a spring disposed in the cavity and operable to bias the armature toward the second position.

3. The electromagnetic actuator of claim 1, wherein the housing does not enclose the armature.

4. The electromagnetic actuator of claim 3, wherein the first gap is formed between the outer peripheral surface of the armature and an interior surface of the housing.

5. The electromagnetic actuator of claim 3, wherein the first gap is formed between an inner surface of the armature and an exterior surface of the housing.

6. The electromagnetic actuator of claim 5, wherein the clamp surface comprises an annular clamp plate partially disposed in the axial passage of the solenoid coil, above the permanent magnet.

7. An electromagnetic actuator comprising:

a housing defining a cavity, said housing having an end wall;

a shaft at least partially disposed in the cavity of the housing and having a longitudinal axis;

a clamp surface disposed in the cavity;

an armature secured to the shaft and extending outward from the shaft to an outer peripheral surface, said armature being movable between a first position disposed proximate to the clamp surface and a second position disposed distal to the clamp surface;

a solenoid coil disposed in the cavity of the housing between the end wall of the housing and the armature, said solenoid coil having first and second ends, an outer periphery and a center axis that is substantially coaxial with the longitudinal axis of the shaft, said first end of the solenoid being disposed distal from the end wall of the housing and said second end of the solenoid coil being disposed proximate to the end wall of the housing, said outer periphery being disposed inward from the outer peripheral surface of the armature; and a permanent magnet fully disposed in the cavity and operable to bias the armature toward the first position, said permanent magnet being disposed proximate to the first end of the solenoid and distal to the second end of the solenoid; and wherein when the armature is in the first position, the armature and the housing define an outwardly-extending first gap therebetween, said first gap having a width in a direction normal to the longitudinal axis of the shaft, wherein when the armature is in the second position, the armature and the clamp surface define a longitudinally-extending second gap therebetween, said second gap having a width in the direction of the longitudinal axis of the shaft, and wherein the width of the second gap is greater than the width of the first gap.

8. The electromagnetic actuator of claim 7 further comprising a spring disposed in the cavity and operable to bias the armature toward the second position.

9. The electromagnetic actuator of claim 7, wherein the housing does not enclose the armature.

10. The electromagnetic actuator of claim 9, wherein the first gap is formed between the outer peripheral surface of the armature and an interior surface of the housing.

11. The electromagnetic actuator of claim 9, wherein the first gap is formed between an inner surface of the armature and an exterior surface of the housing.

12. The electromagnetic actuator of claim 7, wherein the clamp surface comprises an annular clamp plate disposed above the permanent magnet.

13. An electromagnetic actuator comprising:

a housing defining a cavity;

a shaft at least partially disposed in the cavity of the housing and having a longitudinal axis;

a solenoid coil disposed in the cavity of the housing, said solenoid coil having an outer periphery and a center axis that is substantially coaxial with the longitudinal axis of the shaft;

a clamp surface disposed in the cavity, toward the open end;

an armature at least partially disposed exterior to the housing, said armature being secured to the shaft and extending outward from the shaft to an outer peripheral surface, which is disposed outward from the outer periphery of the solenoid coil, said armature being movable between a first position disposed proximate to the clamp surface and a second position disposed distal to the clamp surface, wherein when the armature is in the first position, the armature and the housing define an outwardly-extending first gap therebetween, said first gap having a width in a direction normal to the longitudinal axis of the shaft, wherein when the armature is in the second position, the armature and the clamp surface define a longitudinally-extending second gap therebetween, said second gap having a width in the direction of the longitudinal axis of the shaft, and wherein the width of the second gap is greater than the width of the first gap; and a spring disposed in the cavity and operable to bias the armature toward the second position.

14. The electromagnetic actuator of claim 13, wherein the first gap is formed between the outer peripheral surface of the armature and an interior surface of the housing.

15. The electromagnetic actuator of claim 14, wherein the first gap has a plurality of different widths in the direction normal to the longitudinal axis of the shaft.

16. The electromagnetic actuator of claim 13, wherein the first gap is formed between an inner surface of the armature and an exterior surface of the housing.

17. The electromagnetic actuator of claim 13, wherein the solenoid coil has an axial passage extending therethrough and wherein the clamp surface comprises an annular clamp plate partially disposed in the axial passage.

18. The electromagnetic actuator of claim 17, further comprising a permanent magnetic disposed in the axial passage of the solenoid coil, below the clamp plate.

* * * * *